United States Patent [19]

Off et al.

[11] 4,119,246

[45] Oct. 10, 1978

[54] APPARATUS FOR CRIMPING BELT LOOPS

[75] Inventors: Joseph W. A. Off, Irving; Judson Horace Early, Dallas, both of Tex.

[73] Assignee: Haggar Company, Dallas, Tex.

[21] Appl. No.: 813,635

[22] Filed: Jul. 7, 1977

[51] Int. Cl.[2] ..... D06C 15/00

[52] U.S. Cl. ..... 223/52

[58] Field of Search ..... 223/52, 52.1, 52.2, 223/52.3, 57; 156/461, 463, 467, 202; 83/62, 63, 210

[56] References Cited

U.S. PATENT DOCUMENTS

| | | | |
|---|---|---|---|
| 177,831 | 5/1876 | Hart | 223/52 |
| 2,702,067 | 2/1955 | Goldberg | 156/467 |
| 3,169,428 | 2/1965 | Owen | 83/27 |
| 3,307,995 | 3/1967 | Martin | 156/216 |
| 3,388,017 | 6/1968 | Grimsley | 156/203 |
| 3,407,690 | 10/1968 | Stanley | 83/47 |
| 3,489,630 | 1/1970 | Katz et al. | 156/202 |
| 3,514,020 | 5/1970 | Lornitzo | 223/52.1 |
| 3,523,392 | 8/1970 | Carl | 51/99 |
| 3,615,973 | 10/1971 | Meedler | 156/79 |
| 3,661,106 | 5/1972 | Huddelston | 112/262 |
| 3,757,618 | 9/1973 | Kuts | 83/471.3 |
| 3,758,364 | 9/1973 | Edelman | 156/463 |
| 3,760,669 | 9/1973 | Rosenthal et al. | 83/63 |
| 3,763,728 | 10/1973 | Blackman | 83/210 |
| 3,793,915 | 2/1974 | Hujer | 83/62 |
| 3,822,624 | 7/1974 | Skoji et al. | 83/208 |

FOREIGN PATENT DOCUMENTS

| | | | |
|---|---|---|---|
| 556,438 | 4/1957 | Belgium | 223/52.1 |
| 928,384 | 6/1963 | United Kingdom | 156/467 |

*Primary Examiner*—Henry S. Jaudon

*Attorney, Agent, or Firm*—Richards, Harris & Medlock

[57] ABSTRACT

An apparatus for automatically crimping precut belt loops receives precut belt loops and directs them along a predetermined input path. A diverter member located in the input path separates the belt loops into two crimper/input paths. The belt loops in each crimper/input path are individually positioned for crimping by a gate assembly extending across each path below a crimper blade mounted for displacement. An aligning assembly between each gate and crimper blade properly aligns each belt loop relative to the crimper blade. A light/-photosensor senses a positioned belt loop to activate the aligning assembly and the crimper blade, which extends to push the belt loop through an aperture. A pair of endless belts receives each crimper blade having a belt loop folded thereabout and compresses the folded belt loop to complete the crimping of the precut belt loop. Each gate assembly is mounted for selective movement out of the input path to clear the apparatus of positioned but unfolded belt loops.

36 Claims, 7 Drawing Figures

APPARATUS FOR CRIMPING BELT LOOPS

BACKGROUND AND SUMMARY OF THE INVENTION

The present invention relates to improvements in apparatus for making belt loops, and more particularly to an apparatus for automatically crimping precut belt loops.

In the manufacture of trousers and similar garments, belt loops are frequently provided at spaced intervals around the waistband of the garment. In accordance with the present invention, belt loops are formed from a length of interfacing material having lengths of cloth matching the garment wrapped thereabout. The cloth is attached to the interfacing by means of adhesive. The interfacing is supplied in a continuous length having shorter lengths of matching cloth wrapped about and attached thereto to form "loop strings." Numerous splices are present along the length of the loop string where pieces of the cloth material abut. The individual belt loops are cut from the loop strings and the splices are removed and discarded. Depending upon style or fashion trends, the individual belt loops can be, for example, up to 1¼ inches wide and from about 1 to about 3 inches or more in length.

Each belt loop is affixed or sewn at its ends at spaced locations around the waistband to complete the finished garment. It is customary to fold at least the upper ends of the belt loops inwardly in order to eliminate the conspicuous presence of stitching that would otherwise tend to detract from the appearance of the garment. In accordance with the present invention, the belt loops are crimped to provide a fold at one end thereof, the crimping step being carried out separately from and prior to the step of attaching the belt loops to the garment. This may be contrasted with the prior procedure whereby the folding step was carried out manually or at best semiautomatically, and simultaneously with the attachment of the belt loops to the garment.

The present invention comprises a belt loop crimping apparatus. In accordance with the broader aspects of the invention, precut belt loops are received and guided into position for crimping by heated crimper blades. The crimped belt loops are compressed while allowed to cool in preparation for attachment to the garment, thereby eliminating the manual operations which have heretofore been required.

In accordance with more specific aspects of the invention, precut belt loops are received and separated into two columns of descending belt loops. The individual belt loops are guided into a position to activate an adjacent crimper blade, which can be heated with an electrical heater or with steam. The heated crimper blade extends to fold or crimp the belt loop by pushing it through cooperating aperture means in the belt loop guide means. The crimped, heated belt loop is pushed into engagement between two moving endless belts before the crimper blade retracts. The moving endless belts serve to simultaneously transport, compress and cool the belt loops prior to deposition of the crimped belt loops in a receptacle.

DESCRIPTION OF THE DRAWINGS

A more complete understanding of the invention may be had by referring to the following Detailed Description when taken in conjunction with the accompanying drawings, wherein.

DETAILED DESCRIPTION

Figure 1:
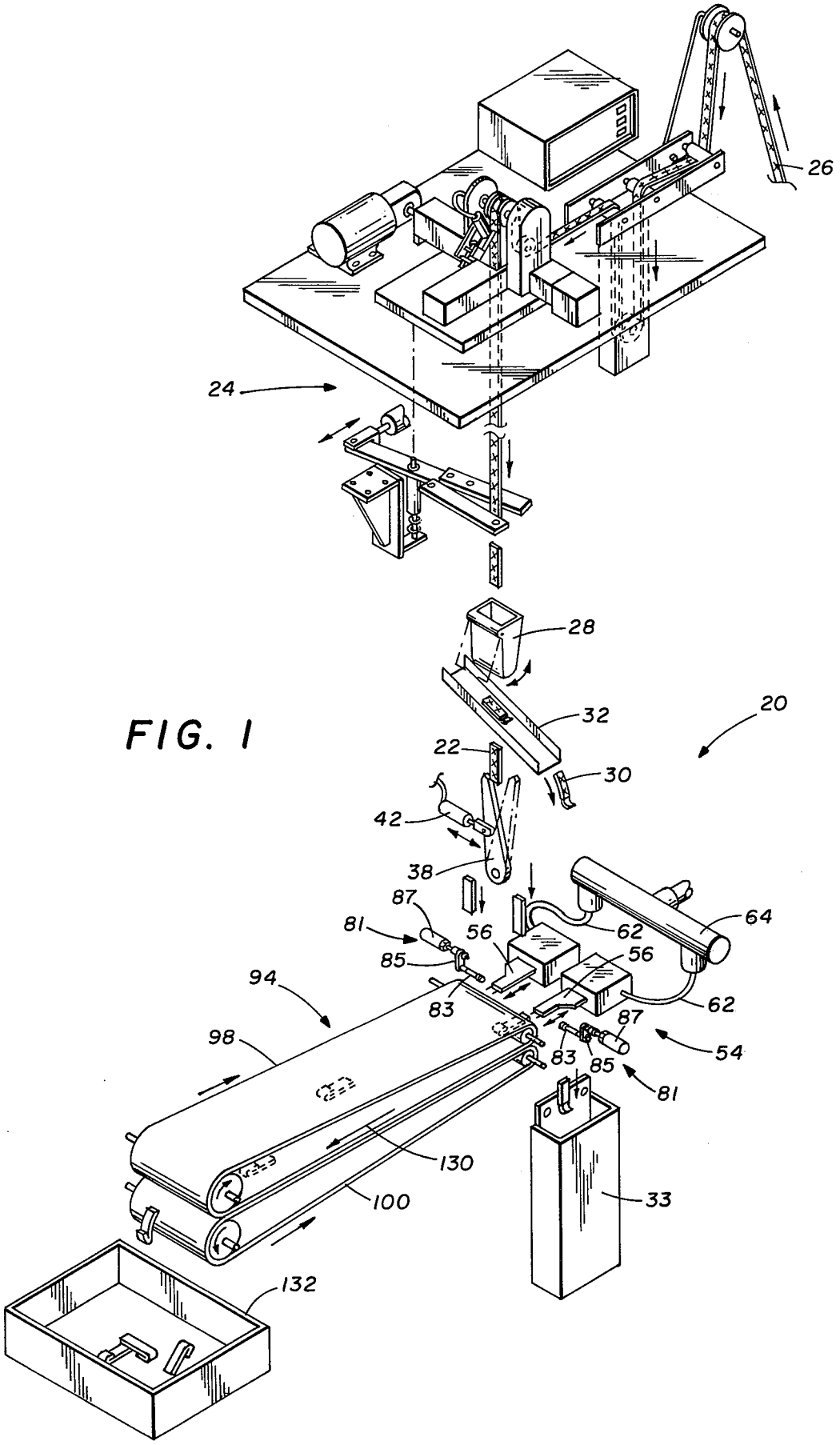
FIG. 1 is a perspective view showing an apparatus for crimping belt loops incorporating the invention receiving belt loops from a loop string feeding, metering and trimming portion of the system.

Referring now to the Drawings and particularly to FIG. 1 thereof, there is shown an apparatus for crimping belt loops 20 incorporating the invention. The apparatus 20 is used in the manufacture of trousers and other garments which utilize belt loops. The apparatus 20 is designed to receive and separate a column of belt loops 22 into two columns which are individually crimped by heated blade means before being pressed and cooled between two moving endless belts.

Preferably, the apparatus for crimping belt loops 20 may be advantageously combined with belt loop cutting apparatus 24. An example of such a belt loop cutting apparatus 24 is fully illustrated and described in copending patent application Ser. No. 559,340 filed Mar. 17, 1975 for "Belt Loop Trimming Apparatus" and assigned to the assignee hereof, which disclosure is herein incorporated by reference. Briefly, the belt loop cutting apparatus 24 receives a continuous length of loop string material 26, which is formed by attaching pieces of cloth matching the garment to a length of interfacing material. The loop string material 26 is automatically metered and trimmed to predetermined belt loop lengths. Portions of the loop string material 26 containing splices where adjoining pieces of cloth abut on the interfacing material are located, and then sorted from the precut belt loops 22 by means of a guide chute 28. Guide chute 28 includes a deflector plate, which when actuated causes spliced portions 30 to be deposited into a scrap chute 32 for collection in scrap receptacle 33. Properly cut belt loops 22 are allowed to pass through guide chute 28 to belt loop crimping apparatus 20.

Figure 2:
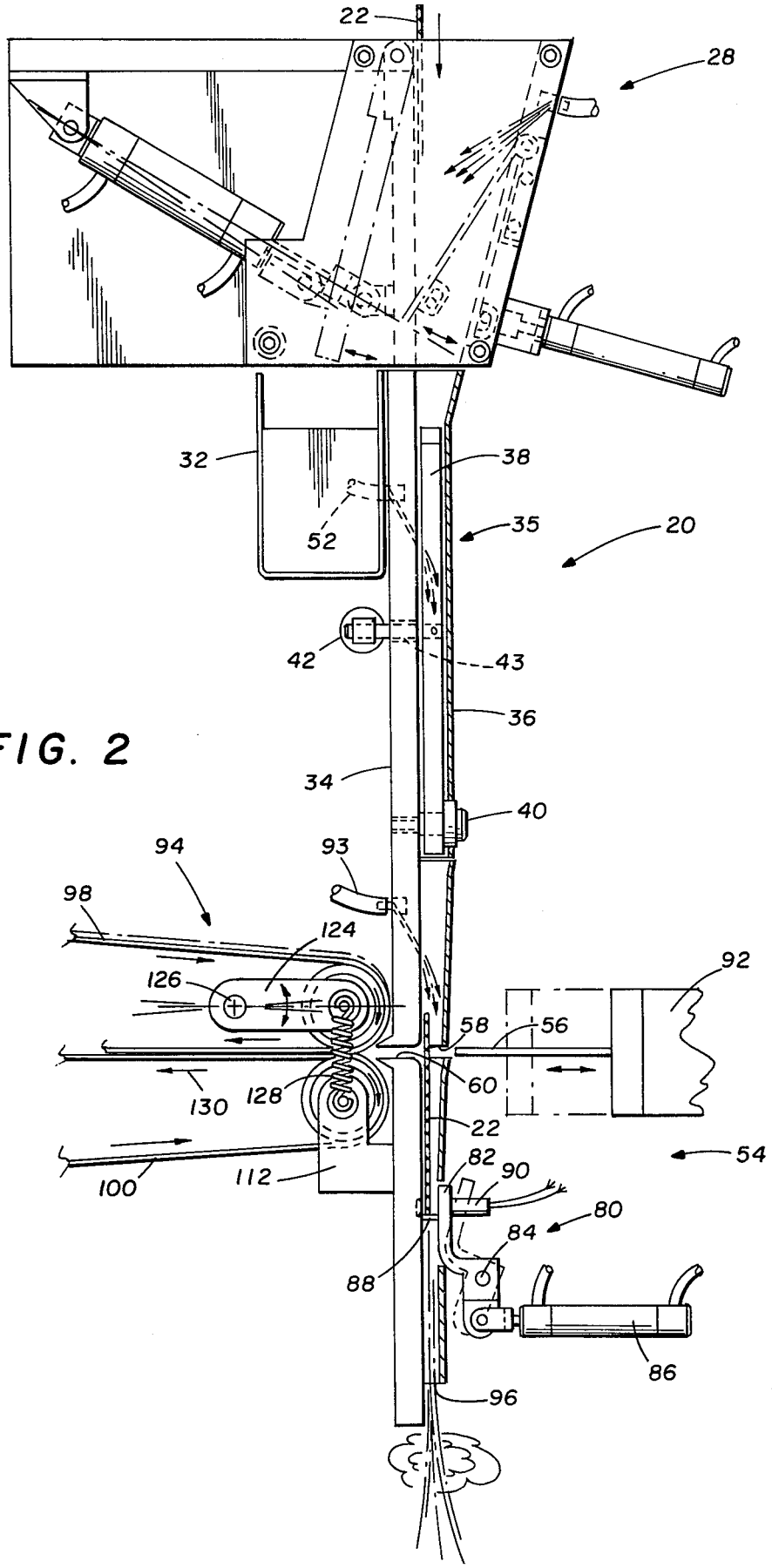
FIG. 2 is a side view of the belt loop crimping apparatus shown in FIG. 1 in which certain parts have been broken away to illustrate more clearly certain features of the invention.

Referring to FIG. 2 in conjunction with FIG. 1, belt loop crimping apparatus 20 receives precut belt loops 22 in a substantially flat or uncrimped condition. Preferably, belt loops 22 are received in a substantially vertical orientation with the backs thereof facing a predetermined direction. Apparatus 20 comprises a rigid base plate 34 to which is attached a cover 36. Base plate 34 and cover 36 cooperate to define an enclosure 35 which gradually tapers in cross sectional area as the belt loops 22 pass therethrough. Preferably, the interior surfaces of enclosure 35 are of sufficiently smooth materials and construction to allow movement of belt loops 22 without interruption or snagging.

Diverter 38 is positioned within and below the receiving end of enclosure 35. Diverter 38 comprises a wedge shaped member which is mounted for pivotal movement about the axis of horizontal shaft 40. Shaft 40 extends between base plate 34 and cover 36, through the major end of diverter 38. Diverter 38 is actuated by means of a double acting cylinder 42 coupled to a crank arm 43 pivoted to diverter 38. A suitable slot within base plate 34 allows reciprocation of crank arm 43. Cylinder 42 is responsive to the rate at which belt loops 22 enter belt loop crimping aparatus 20 so as to reciprocate diverter 38 within enclosure 35 in a plane parallel with the movement of belt loops 22.

Figure 3:
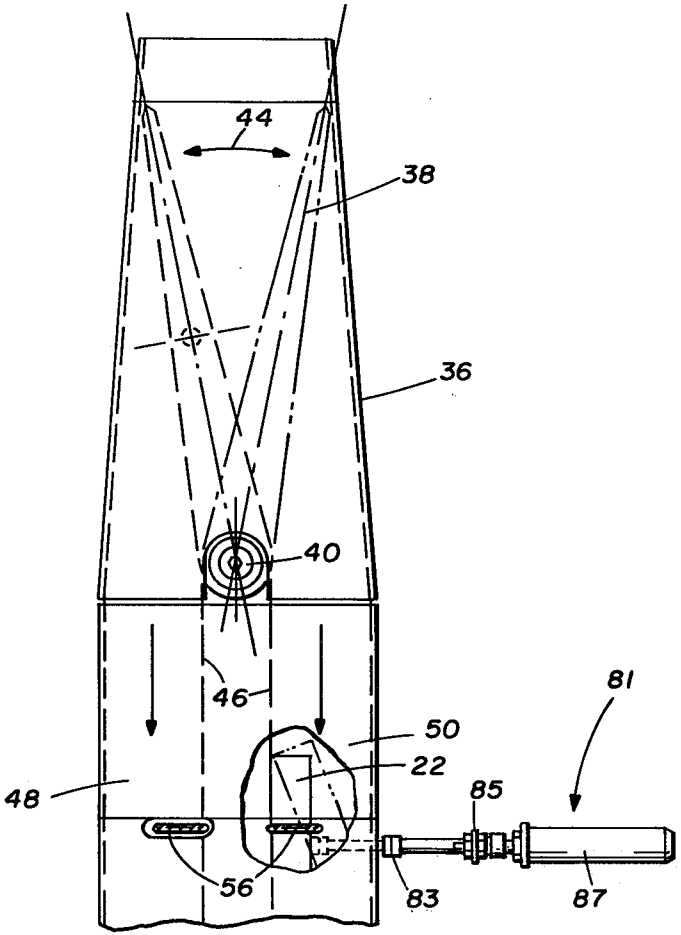
FIG. 3 is an enlarged elevational view of a portion of the crimper/input paths in which certain parts have been broken away to illustrate more clearly certain features of the invention.

Referring to FIG. 3, arrows 44 illustrate the directions of reciprocation of diverter 38. Two longitudinal rib members 46 extend downstream of shaft 40 between base plate 34 and cover plate 36 to define left and right channels 48 and 50, respectively, for receiving diverted belt loops 22. Therefore, it will be understood that belt loops 22 enter and initially proceed through apparatus 20 in a singular path before encountering diverter 38. Diverter 38 causes alternate belt loops 22 to follow either a left or right parallel path. Air jet 52, which includes a source of pressurized air (not shown) connected to an orifice in base plate 34, is provided for urging belt loops 22 through apparatus 20.

Referring to FIG. 3 in conjunction with FIGS. 1 and 2, belt loops 22 proceed through channels 48 and 50 until reaching a position adjacent to crimper blade assembly 54. Crimper blade assembly 54 comprises two crimper blades 56 mounted for reciprocal movement in directions substantially perpendicular to one side of belt loops 22. A crimper blade 56 is provided adjacent to each channel 48 or 50, and in alignment with opposed apertures 58 and 60 in cover 36 and base plate 34 respectively. Aperture 58 is of sufficient size to receive crimper blade 56, while aperture 60 is relatively larger to accommodate crimper blade 56 with a belt loop 22 wrapped about the front end thereof. The crimper blades 56 are of substantially hollow construction and are connected by means of conduits 62 to a superheater assembly 64.

Figure 4:
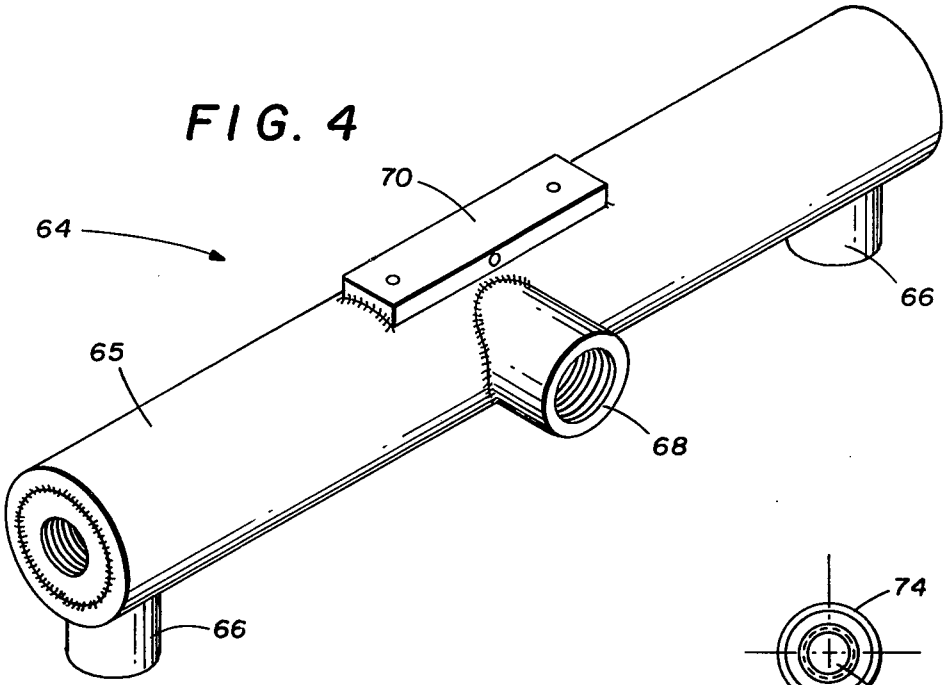
FIG. 4 is an enlarged perspective view of the superheater portion of the invention.

Turning momentarily to FIG. 4, there is shown the superheater assembly 64. Superheater 64 comprises a generally cylindrical shell 65 having outlets 66 positioned at opposite ends thereof. Outlets 66 are connected to conduits 62 leading to crimper blades 56. An inlet 68 is situated substantially centrally along the length of the shell 65 and is connected to a conventional source of steam (not shown). If desired, a thermostat pad 70 may be mounted on the shell 65 to sense the temperature of the assembly so that the temperature thereof can be held constant.

Figure 6:
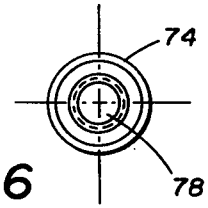
FIG. 6 is an enlarged end view of the core member illustrated in FIG. 5.
Figure 5:
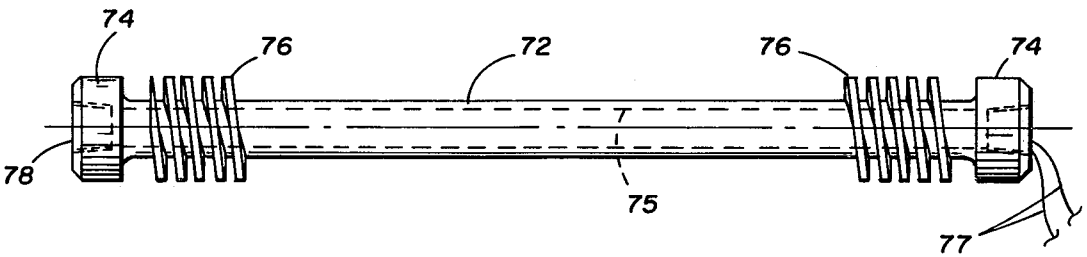
FIG. 5 is an enlarged top view of the core member for the superheater portion of the invention shown in FIG. 4.

Disposed within superheater 64 is core member 72 which is shown in FIGS. 5 and 6. Core member 72 is of substantially hollow construction and has raised portions 74 at each end thereof. The intermediate portion of core member 72 is of relatively lesser diameter. A spiral fin 76 having a diameter substantially equal to that of end portions 74 is positioned inwardly and adjacent to each end portion 74. When core 72 is assembled with shell 65, it will be apparent that steam entering inlet 68 passes through the annulus so formed, and around the spiral fins 76 before reaching outlets 66. Heating means such as an electrical element 75 connected by cable 77 to a suitable source of electrical power (not shown) is positioned within bore 78 to further elevate the temperature of the steam passing through superheater 64 to crimper blades 56.

The capability of controlling the temperature of the steam heating the crimper blades 56 comprises a significant advantage of the present invention. The temperature of the crimper blades 56 may be more accurately regulated as a function of the exact material of the belt loop to be crimped. In addition, superheater assembly 64 may be used to correct temperature losses in the steam resulting from remote location of the steam source.

Returning to FIG. 3 in conjunction with FIGS. 1 and 2, each belt loop 22 within channels 48 and 50 is positioned across apertures 58 and 60 by means of stop assembly 80. A stop assembly 80 is located beneath each crimper blade assembly 54 and within an opening in cover plate 36. Stop assembly 80 comprises an arm 82 mounted for pivotal movement about the axis of horizontal shaft 84. Arm 82 is operated by double acting cylinder 86 which is coupled thereto. A stop gate 88 extends from arm 82 to contact the inner surface of base plate 34. Stop assembly 80 also includes lamp/photosensor 90 preferably mounted in arm 82 above stop gate 88. Each lamp/photosensor 90 is electrically connected to a control unit (not shown) and projects a light beam above gate 88 and across channel 48 or 50 of enclosure 35. The light beam is projected onto an opposing reflective surface in enclosure 35, which reflects the beam back to lamp/photosensor 90. Belt loops 22 resting against stop 88 will break or interrupt the reflected beam to the lamp/photosensor 90 to signal that a belt loop 22 is present for crimping. It will be understood that a stop assembly 80 is provided for each channel 48 and 50 beneath the respective crimper blade 56. Moreover, stop assembly 80 can be mounted for movement parallel to the input path of belt loops 22 so that various lengths of belt loops can be positioned with respect to crimper blades 56.

As is best shown in FIG. 1 and 3, alignment assemblies 81 are provided to the outside of and adjacent to channels 48 and 50. For clarity, only one alignment 81 is shown in FIG. 3. Each alignment assembly 81 is positioned between stop assembly 80 and crimper blade assembly 54. Alignment assembly 81 includes a foot 83 mounted for reciprocal movement in a direction substantially perpendicular to the direction of movement of crimper blade 56. Foot 83 is connected at one end by member 85 to double acting cylinder 87. Cylinder 87 is responsive to lamp/photosensor 90 to extend foot 83 through an opening in enclosure 35 toward engagement with one longitudinal edge of a stationary belt loop 22. Consequently, a belt loop 22 initially resting against stop 88, as shown in phantom lines, breaks the reflected beam of lamp/photosensor 90 to signal cylinder 87 to extend foot 83. Thus, foot 83 nudges belt loop 22 against rib member 46 to a position as shown in full lines so as to orient the longitudinal axis of the belt loop substantially perpendicularly with the plane of crimper blade 56. It will be understood that an alignment assembly 81 is provided for each channel 48 and 50 beneath the respective crimper blade 56. Moreover, alignment assemblies 81 can be mounted for movement toward and away from the input path of belt loops 22 whereby various widths of belt loops can be properly aligned with respect to crimper blades 56.

Each belt loop 22 passes through channel 48 or 50 under the force of air jet 52 until engagement with stop gate 88. A belt loop 22 thus positioned breaks the beam of lamp/photosensor 90 to initiate the cycles of double acting cylinders 87 and 92. If desired, the signal from lamp/photosensor 90 can also be utilized to open a valve (not shown) between superheater 64 and crimper blades 56. In this manner, a timed discharge of superheated steam can be applied to crimper blades 56.

Cylinder 87 actuates foot 83 toward belt loop 22 to properly align the belt loop relative to crimper blade 56. Cylinder 92 actuates heated crimper blade 56 toward engagement with the positioned belt loop 22. However, because cylinder 87 cycles relatively quicker than does cylinder 92, foot 83 of alignment assembly 81 will have retracted without interference with crimper blade 56. Accordingly, crimper blade 56 extends through aperture 58 to engage and push aligned belt loop 22 through aperture 60. Belt loop 22 is wrapped about the forward end of crimper blade 56 as it is pushed into engagement with conveyor portion 94. After belt loop 22 has been engaged by conveyor portion 94, crimper blade 56 is disengaged therefrom by cylinder 92 and retracted to an initial position shown in full lines in FIG. 2 to complete the cycle.

It will be apparent that normal and oversized belt loops will be engaged and crimped, however, crimper blades 56 will not engage undersized belt loops, which will remain positioned against stops 88. Consequently, cylinders 87 and 92 will have cycled without removing the interruption from the light beam of lamp/photosensor 90. Lamp/photosensor 90 thus senses the continued presence of a belt loop and actuates cylinder 86 and air jet 93. Cylinder 86 cycles arm 82 momentarily to the position shown in dashed lines in FIG. 2. Thus, stop 88 is momentarily disengaged from enclosure 35 whereby air jet 93 clears the apparatus by expelling the undersized belt loop 22 through outlet 96.

Figure 7:
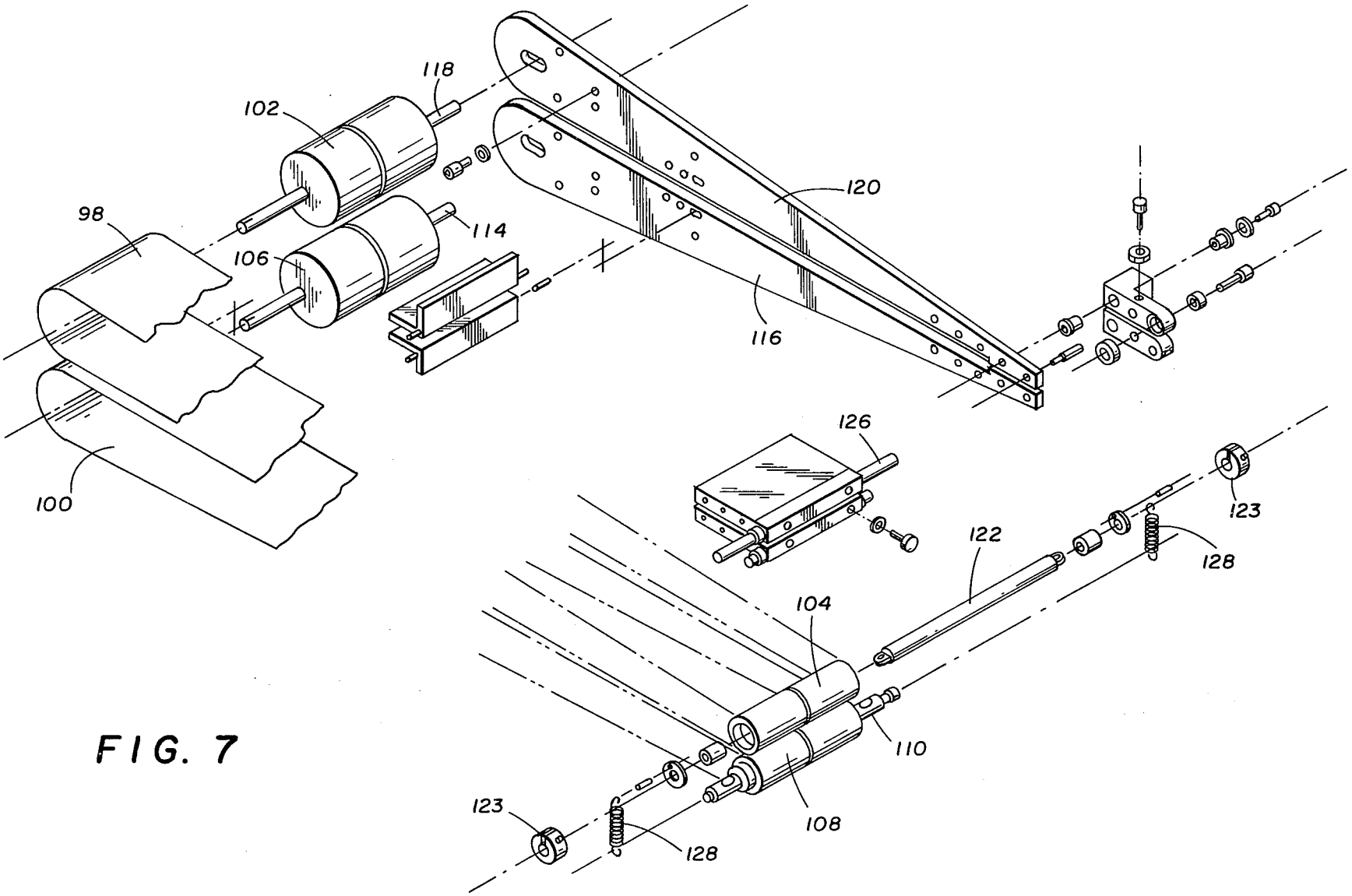
FIG. 7 is an enlarged exploded view illustrating the conveyor portion of the invention.

With reference to FIG. 7 in conjunction with FIGS. 1 and 2, there is shown the conveyor portion 94 which receives the crimped belt loops 22 from both crimper blades 56. Conveyor portion 94 is positioned opposite crimper blades 56 and behind apertures 60. Conveyor portion 94 includes two adjacent endless belts 98 and 100 in vertical arrangement. Belt 98 is constrained for movement about rear roller 102 and forward roller 104. Similarly, belt 100 is constrained for movement about rear roller 106 and forward roller 108. Roller 108 is supported for rotation by shaft 110 which extends between support members 112, which may be attached to base plate 34. Roller 106 is supported for rotation about shaft 114 mounted between lower side plates 116, only one of which is shown. Rear roller 102 for belt 98 is mounted for rotation about shaft 118 which extends similarly between upper side plates 120, only one of which is shown. Forward roller 104 of belt 98 is supported for rotation by shaft 122. Spherical bearings 123 mounted in links 124 carry shaft 122 therebetween. Links 124 in turn are pivoted about the axis of shaft 126 extending between upper side plates 120. It will be apparent that spherical bearings 123 permit limited twisting of the forward end of belt 98 without binding shaft 122. Connected between shafts 110 and 122, springs 128 function to yieldingly urge each side of the forward end of upper belt 98 into contact with the forward end of lower belt 100. Downstream of links 124 adjacent surfaces of belts 98 and 100 are in continuous contact. The endless belts 98 and 100 are driven by conventional means, such as for instance an electric motor (not shown), in opposite directions synchronously so that the adjacent contacting surfaces of belts 98 and 100 move away from crimper blades 56 in the direction of arrow 130. Consequently, conveyor portion 94 yieldingly receives the forward portions of crimper blades 56 about which belt loops 22 are folded. The belt loops 22 are engaged in alternation between either side of endless belts 98 and 100 and separated from heated crimper blades 56. Simultaneously transported and pressed, belt loops 22 thus set or cool in the pressed condition prior to being deposited in container 132.

In view of the foregoing, it will be understood that the present invention comprises an apparatus for crimping belt loops which incorporate numerous advantages over the prior art. By means of the invention, belt loops are received and separated into two parallel columns of belt loops. The belt loops are automatically positioned for crimping, crimped by heated blades, pressed and allowed to cool thereby eliminating time consuming and costly manual operations which have heretofore been required.

Although a particular embodiment of the invention has been illustrated in the accompanying Drawings and described in the foregoing Detailed Description, it will be understood that the invention is not limited to the embodiment disclosed, but is capable of numerous rearrangements, modifications, and substitutions of parts and elements without departing from the spirit and scope of the invention as defined in the appended claims.

What is claimed is:

1. Apparatus for automatically crimping precut belt loops, which comprises:

means for receiving precut belt loops in substantially vertical orientation and unfolded condition;

means for directing received belt loops along a predetermined input path;

means positioned adjacent the input path for folding each belt loop in the input path;

means for individually positioning belt loops in the input path for folding by the folding means;

means for sensing a positioned belt loop in the input path and for operating the folding means to fold said belt loop; and means positioned adjacent the input path and opposite the folding means for receiving folded belt loops and for directing the received folded belt loops in a crimped condition along a predetermined path.

2. The apparatus for automatically crimping precut belt loops as recited in claim 1, further comprising:

first air jet means positioned in the means for directing received belt loops so that the belt loops are propelled by a stream of air along the input path.

3. The apparatus for automatically crimping precut belt loops as recited in claim 1, wherein the means for folding the belt loops comprises:

crimper blade means mounted for displacement with respect to a positioned belt loop; and means responsive to the sensing means for actuating the crimper blade means to extend toward a positioned belt loop, to engage and push said belt loop through an aperture in the directing means whereby individual belt loops are folded about the front end of said crimper blade means.

4. The apparatus of claim 3 wherein the crimper blade means is of substantially hollow construction and is connected to a source of steam so that the crimper blade means is heated.

5. The apparatus of claim 4, further comprising:
means positioned in the connection between the crimper blade means and the steam source for superheating the steam thereby further elevating the temperature of the crimper blade means.

6. The apparatus for automatically crimping precut belt loops as recited in claim 1 wherein the means for individually positioning belt loops comprises:
gate means extending across the input path and situated a predetermined distance below the folding means so that each belt loop is blocked in a stationary position with respect to the folding means.

7. The apparatus of claim 6 wherein the gate means is mounted for movement parallel to the belt loop input path so that the apparatus can be adjusted to crimp precut belt loops of various lengths.

8. The apparatus of claim 6 wherein the means for individually positioning belt loops further comprises:
means positioned adjacent the input path a predetermined distance above the gate means for aligning the stationary belt loops with respect to the folding means.

9. The apparatus of claim 8 wherein the means for aligning the belt loops is mounted for movement toward and away from the belt loop input path so that the apparatus can be adjusted to crimp precut belt loops of various widths.

10. The apparatus for automatically crimping precut belt loops as recited in claim 1 wherein the means for sensing a positioned belt loop comprises:
a lamp/photosensor positioned between the folding means and the positioning means, said lamp/photosensor directing light across the input path and receiving light, reflected from reflection means whereby the light path is interrupted when a belt loop is positioned for folding.

11. The apparatus for automatically crimping precut belt loops as recited in claim 1 wherein the means for receiving folded belt loops comprises:
a pair of endless belts having adjacent surfaces in contact and positioned to receive between said endless belts folded belt loops from the folding means.

12. The apparatus for automatically crimping precut belt loops as recited in claim 1 further comprising:
diverter means positioned in the input path above the folding means for separating some of the incoming belt loops into a second input path;
means positioned adjacent the second input path for folding each belt loop in the second input path;
means for individually positioning belt loops in the second input path for folding by the second folding means; and
means for sensing a positioned belt loop in the second input path and for operating the second folding means to fold said belt loop;
wherein the means for receiving folded belt loops from the first folding means also receives folded belt loops from the second folding means.

13. Apparatus for automatically crimping precut belt loops, which comprises:
means for receiving precut belt loops in substantially vertically orientation and unfolded condition;
means for directing received belt loops along a predetermined input path;
diverter means positioned in the input path for separating the belt loops into at least two paths;
means for directing the belt loops along at least two predetermined crimper/input paths;
means positioned adjacent each crimper/input path for folding the belt loops in each of said paths;
means for individually positioning belt loops in each crimper/input path for folding by the folding means, said positioning means being situated beneath the folding means;
means for sensing a positioned belt loop and for operating the respective folding means when a belt loop is positioned in each crimper/input path; and
means positioned adjacent each crimper/input path and opposite the folding means for receiving folded belt loops from the folding means and directing the received folded belt loops in a compressed condition along a predetermined output path for collection as crimped belt loops.

14. The apparatus for automatically crimping precut belt loops as recited in claim 13 further comprising:
first air jet means located in the means for directing received belt loops along an input path whereby the belt loops are propelled by a stream of air along the input path.

15. The apparatus for automatically crimping precut belt loops as recited in claim 13 wherein the diverter means comprises:
a wedge shaped member positioned in the input path, said wedge shaped member being mounted for pivotal movement; and
means for actuating the diverter so that successive belt loops in the input path are separated into one of the crimper/input paths.

16. The apparatus for automatically crimping precut belt loops as recited in claim 13 wherein the means for folding the belt loops comprises:
a crimper blade mounted for displacement and positioned adjacent each predetermined crimper/input path; and
means for actuating each crimper blade to extend toward a positioned belt loop, to engage and push said belt loop through an aperture in the directing means whereby individual belt loops are folded about the front end of each crimper blade.

17. The apparatus of claim 16 wherein each crimper blade is of substantially hollow construction and is connected to a source of steam so that each crimper blade is heated.

18. The apparatus of claim 17 further comprising:
means positioned in the connections between each crimper blade and the steam source for superheating the steam thereby further elevating the temperature of each crimper blade.

19. The apparatus for automatically crimping precut belt loops as recited in claim 13 wherein the means for individually positioning belt loops comprises:
gate means extending across each crimper/input path, so that individual belt loops are blocked in a stationary position adjacent to each folding means.

20. The apparatus of claim 19 wherein each gate means is mounted for movement parallel to the respective crimper/input path so that the apparatus can be adjusted to crimp belt loops of various lengths.

21. The apparatus of claim 19 wherein the means for individually positioning belt loops further comprises:
means positioned adjacent each crimper/input path a predetermined distance above the gate means for aligning individual, stationary belt loops relative to the respective folding means.

22. The apparatus of claim 21 wherein the means for aligning the belt loops is mounted for movement toward and away from the respective crimper/input path so that the apparatus can be adjusted to crimp belt loops of various widths.

23. The apparatus for automatically crimping precut belt loops as recited in claim 13 wherein the means for sensing positioned belt loops comprises:

a lamp/photosensor positioned between each folding means and the respective means for positioning individual belt loops in each crimper/input path, said lamp/photosensor directing light across the crimper/input path and receiving light reflected from reflection means whereby the light path is interrupted when a belt loop is positioned for folding.

24. The apparatus for automatically crimping precut belt loops as recited in claim 13 wherein the means for receiving the folded belt loops comprises:

a pair of endless belts having adjacent surfaces in contact and positioned to receive therebetween the folded belt loops from each folding means.

25. The apparatus of claim 24 wherein the receiving ends of said pair of endless belts are biased together to yieldingly receive the forward end of each folding means, to contact and to separate each folded belt loop from each folding means.

26. The apparatus for automatically crimping precut belt loops as recited in claim 13 wherein the sensing means also senses the continued presence of a positioned belt loop after operation of the respective folding means, and further comprising means for clearing each crimper/input path of each belt loop positioned for folding but unengaged by the folding means.

27. Apparatus for automatically crimping precut belt loops, which comprises:

structure for receiving precut belt loops in substantially vertical orientation and unfolded condition;

structure for directing received belt loops along a predetermined input path;

a wedge shaped diverter member positioned in the input path and mounted for pivotal movement;

means for actuating the diverter member to separate successive belt loops in the input path into two paths;

structure for directing separated belt loops along first and second predetermined crimper/input paths;

first and second crimper blades mounted for displacement and positioned adjacent the respective crimper/input paths;

first and second means for actuating the respective crimper blades;

first and second gate means situated beneath the respective crimper blades, and extending across the respective crimper/input paths to halt individual belt loops for folding adjacent said crimper blades;

said first and second gate means being mounted for movement for adjusting the apparatus to crimp belt loops of various lengths;

first and second lamp/photosensors positioned adjacent the respective crimper/input paths, and between the respective crimper blades, and the respective gate means;

said lamp/photosensors directing light across the respective crimper/input path and receiving light reflected from reflection means whereby the light path is interrupted when a belt loop is properly positioned for folding;

said first and second crimper blade actuation means being responsive to the respective lamp/photosensors to actuate said crimper blades to extend toward a positioned belt loop, engaging and pushing the belt loop through an aperture in the respective directing structure whereby individual belt loops are folded about the front ends of said crimper blades; and a pair of endless belts having adjacent surfaces in contact and positioned adjacent the first and second crimper/input paths opposite the first and second crimper blades to receive therebetween folded belt loops from the extended first and second crimper blades and to direct the received folded belt loops in a compressed state along a predetermined output path for collection as crimped belt loops.

28. The apparatus of claim 27 wherein the first and second crimper blades are of substantially hollow construction and are connected to a source of steam so that said crimper blades are heated.

29. The apparatus of claim 27 further comprising first air jet means mounted in the structure for urging received belt loops through the apparatus.

30. The apparatus of claim 27 wherein the receiving ends of said pair of endless belts are biased together to yieldingly receive the first and second crimper blades.

31. The apparatus of claim 30 wherein each side of the forward portion of one of the endless belts is individually mounted so that each side thereof may yieldingly and independently receive one of said crimper blades.

32. The apparatus of claim 27 further comprising:

first and second means for selectively actuating the respective gate means out of the respective crimper/input paths;

first and second means located beneath the respective gate means for directing belt loops along a predetermined discharge path; and second air jet means mounted in the structure for directing belt loops along first and second crimper/input paths;

said first and second gate actuation means and said second air jet means being responsive to the respective lamp/photosensors when the continued presence of a positioned belt loop is sensed after cycling of the respective crimper blade to discharge the unfolded belt loop from the apparatus thereby clearing the apparatus for positioning of the next precut belt loop.

33. The apparatus of claim 27 further comprising:

first and second means for aligning stationary belt loops relative to the respective crimper blades;

said first and second aligning means positioned adjacent the respective crimper/input paths a predetermined distance above the respective gate means and movably mounted so that the apparatus can be adjusted to crimp belt loops of various widths; and first and second means for selectively actuating the respective aligning means to extend toward a stationary belt loop, to engage and nudge said belt loop against a portion of the respective directing structure so that said belt loop is properly positioned;

said first and second actuating means responsive to the respective lamp/photosensors to accomplish belt loop alignment prior to engagement therewith by the respective crimper blades.

34. The apparatus of claim 28 further comprising a steam superheater positioned in the connection between the first and second crimper blades and the steam source, comprising:

a cylindrical shell having a pair of outlet ports positioned at opposite ends thereof and an inlet port positioned substantially centrally along the length of said shell;

a core member of hollow construction and adapted to be received within the shell;

said coremember having an outside diameter intermediate the ends thereof less than that of the inside diameter of the shell to form an annular space between the core member and the shell;

spiral fins positioned at opposite ends of the core member and extending across said annular space; and means for heating the core member so that steam entering the apparatus is superheated as it passes through the annular space and around the spiral fins before entering the outlets of the apparatus.

35. The apparatus of claim 34 wherein the means for heating the core member comprises an electrical resistance element positioned in the hollow core member.

36. The apparatus of claim 34 further comprising a thermostat pad mounted on the exterior of the shell to monitor the temperature of the superheater.

* * * * *

UNITED STATES PATENT AND TRADEMARK OFFICE

CERTIFICATE OF CORRECTION

PATENT NO. : 4,119,246

DATED : October 10, 1978

INVENTOR(S) : Joseph S. W. Off and Judson Horace Early

It is certified that error appears in the above-identified patent and that said Letters Patent are hereby corrected as shown below:

Column 4, line 41, after "alignment" add --assembly--.
Column 6, line 13, change "incorporate" to --incorporates--.
Column 6, line 48 (Claim 1), before "path" add --output--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*